US009073344B2

(12) United States Patent
Kashiwagi

(10) Patent No.: US 9,073,344 B2
(45) Date of Patent: Jul. 7, 2015

(54) IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Ryota Kashiwagi, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/097,652

(22) Filed: Dec. 5, 2013

(65) Prior Publication Data

US 2014/0204169 A1 Jul. 24, 2014

(30) Foreign Application Priority Data

Jan. 18, 2013 (JP) ..... 2013-7160

(51) Int. Cl.

| | |
|---|---|
| ***B41J 29/16*** | (2006.01) |
| ***B41J 2/335*** | (2006.01) |
| ***B41J 2/325*** | (2006.01) |
| ***B41J 11/00*** | (2006.01) |

(52) U.S. Cl.

CPC *B41J 2/335* (2013.01); *B41J 2/325* (2013.01); *B41J 11/002* (2013.01)

(58) Field of Classification Search

USPC ..... 347/171, 179, 101, 156, 222; 399/322, 399/374

See application file for complete search history.

(56) References Cited

U.S. PATENT DOCUMENTS

| | | | | |
|---|---|---|---|---|
| 3,972,612 | A * | 8/1976 | Komori et al. | 399/374 |
| 8,478,151 | B2 * | 7/2013 | Iguchi et al. | 347/101 |
| 2010/0196063 | A1 * | 8/2010 | Iguchi et al. | 399/322 |
| 2010/0272449 | A1 | 10/2010 | Yoshida et al. | |
| 2011/0294052 | A1 | 12/2011 | Aoki et al. | |

FOREIGN PATENT DOCUMENTS

| | | |
|---|---|---|
| JP | 61-41139 | 3/1986 |
| JP | 03-26642 | 2/1991 |
| JP | 08-123266 | 5/1996 |
| JP | 2010-133998 | 6/2010 |
| JP | 2010-253951 | 11/2010 |
| JP | 2011-245860 | 12/2011 |

OTHER PUBLICATIONS

Office Action of Notification of Reasons for Rejection for Japanese Patent Application No. 2013-007160 Dated Jan. 6, 2015, 8 pages.

* cited by examiner

*Primary Examiner* — Kristal Feggins

(74) *Attorney, Agent, or Firm* — Amin, Turocy & Watson, LLP

(57) ABSTRACT

An image forming apparatus of an embodiment includes a heating unit, first and second keeping units, and first and second transport units. The heating unit heats an image formed on a sheet. The first and second keeping units keep sheets. The first transport unit transports the sheet from the first keeping unit to the heating unit to form an image. The second transport unit transports the sheet from the second keeping unit to the heating unit by a transport distance shorter than a sheet transport distance of the first transport unit to erase the image.

4 Claims, 8 Drawing Sheets

IMAGE FORMING APPARATUS

CROSS-REFERENCE TO RELATED APPLICATION

This application is based upon and claims the benefit of priority from the prior Japanese Patent Application No. 2013-7160, filed on Jan. 18, 2013, the entire contents of which are incorporated herein by reference.

FIELD

Embodiments described herein relate generally to an image forming apparatus having a function of forming an image on a sheet and a function of erasing the image formed on the sheet.

BACKGROUND

An image forming apparatus which forms a visible image on a sheet, for example, plain paper, using an erasable color material, is provided. The color material includes, for example, a color compound (a precursor compound of pigment), a developer, and the like. The color compound exhibits a color by an action of the developer.

An erasing device which reduces the action of the developer to the color compound to resolve a coloring state by heating the color material of the image, thereby erasing (non-visualizing) an image, is proposed.

The image forming apparatus includes a fixing unit that heats a color material of an image to fix the image to a sheet. An image forming apparatus having an image erasing function in which the fixing unit also serves as the erasing device is proposed.

However, in the image forming apparatus, in order to erase the image, when the sheet is transported to the fixing unit also serving as the erasing device, excessive loads more than necessary may be applied to the sheet.

In addition, in the image forming apparatus, the sheet subjected to the image erasing several times may lose rigidity (hardness), or may have scratches at peripheral edges.

The sheet losing the rigidity or the sheet having the scratches at the peripheral edges may cause jam of the sheet in the image forming apparatus.

DETAILED DESCRIPTION

Figure 1:
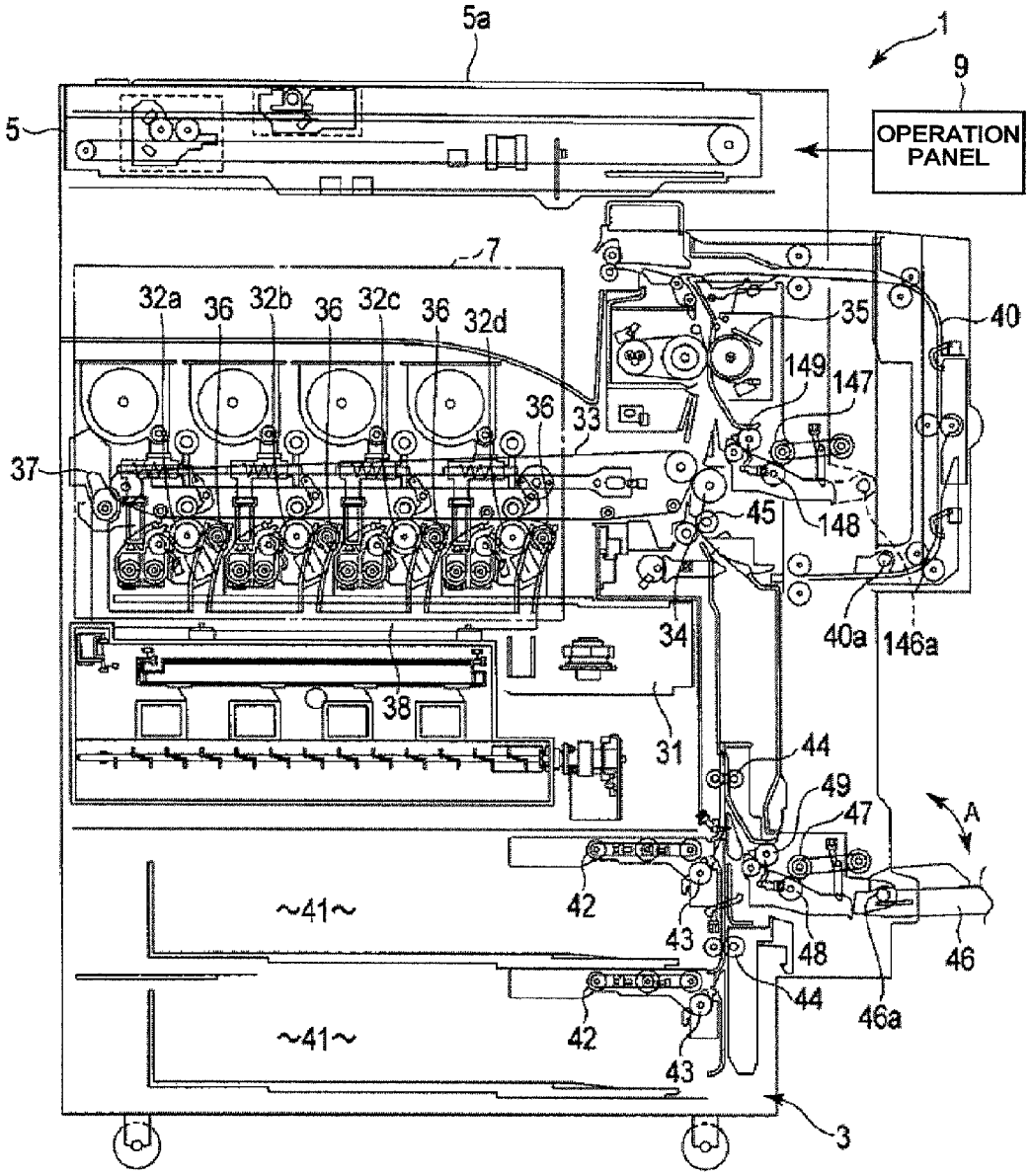
FIG. 1 is a cross-sectional view illustrating an image forming apparatus according to a first embodiment.

According to embodiments, an image forming apparatus having a function of forming an image on a sheet and a function of erasing the image formed on the sheet is provided. The image forming apparatus includes a heating unit, first and second keeping units, and first and second transport units. The heating unit heats the image formed on the sheet. The first and second keeping units keep sheets. The first transport unit transports the sheet from the first keeping unit to the heating unit to form an image. The second transport unit transports the sheet from the second keeping unit to the heating unit by a transport distance shorter than a sheet transport distance of the first transport unit to erase the image.

Hereinafter, the embodiments will be further described with reference to the drawings. In the drawings, the same reference numerals and signs represent the same or similar portions.

Figure 2:
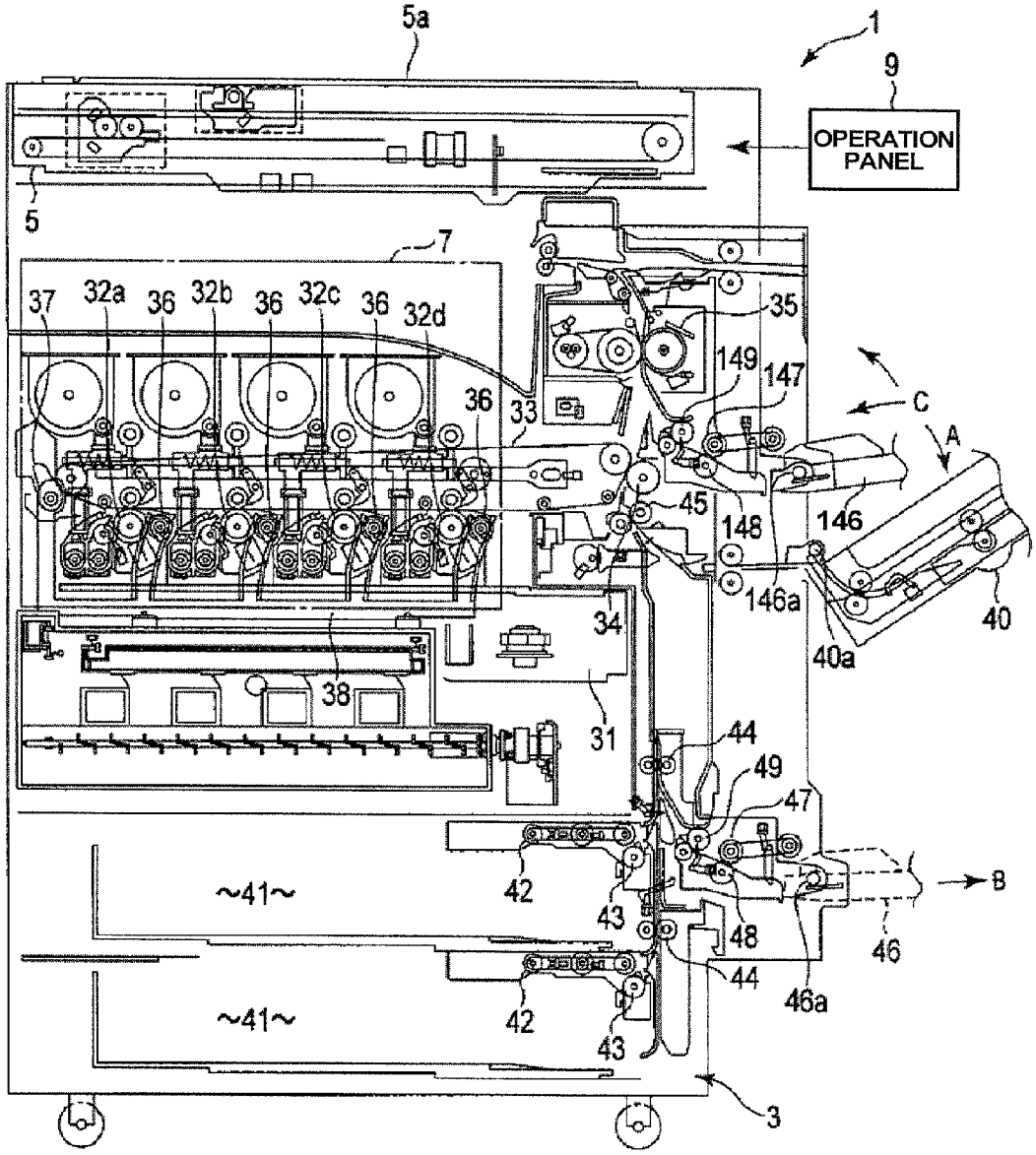
FIG. 2 is a cross-sectional view illustrating the image forming apparatus at the time of an erasing operation according to the first embodiment.

A first embodiment will be described with reference to FIGS. 1 and 2. FIG. 1 is a cross-sectional view illustrating main units of an image forming apparatus 1 of the first embodiment. FIG. 2 is a cross-sectional view illustrating the image forming apparatus 1 at the time of an erasing operation according to the first embodiment. The image forming apparatus 1 is multi-function peripherals (MFP). Hereinafter, the image forming apparatus 1 is simply referred to as MFP 1.

The MFP 1 includes a fixing unit 35 as the heating unit. The MFP 1 includes a first input tray 46 and a second input tray 146 as the first and second keeping units. The MFP 1 includes a sheet feeding mechanism 47, a separation mechanism 48, and a timing matching mechanism 49, as the first transport unit. The MFP 1 includes a sheet feeding mechanism 147, a separation mechanism 148, and a timing matching mechanism 149, as the second transport unit.

The MFP 1 includes at least an image forming unit 3, an image reading unit 5, and a signal process/operation control unit (a circuit board) 7. Hereinafter, the signal process/operation control unit 7 is simply referred to as a control unit 7. The control unit 7 is formed of, for example, a circuit board. The MFP 1 further includes an operation panel 9, for example, a display panel at a predetermined position.

The image forming unit 3 forms a visualized image corresponding to image data on a sheet such as paper or a resin sheet. The image data is, for example, data obtained by converting an image signal generated by the image reading unit 5, by the control unit 7. The image data may be data obtained from the outside. The data obtained from the outside may be data read from a storage medium such as a semiconductor memory by the MFP 1, and may be data received from an external device such as a PC through an I/F (interface) 71 (see FIG. 3) by the MFP 1.

The image reading unit 5 acquires characters or an image of a reading target as brightness of light, and generates an image signal corresponding to the brightness.

The image reading unit 5 includes at least a manuscript table (a manuscript glass) 5*a*, an illumination device, and an image sensor. The manuscript table 5*a* supports a manuscript that is the reading target. The illumination device illuminates the manuscript with light. The image sensor converts reflection light (image information) reflected from the manuscript into an image signal. The image sensor is, for example, a CCD sensor or a complementary metal-oxide semiconductor (CMOS) sensor.

Figure 3:
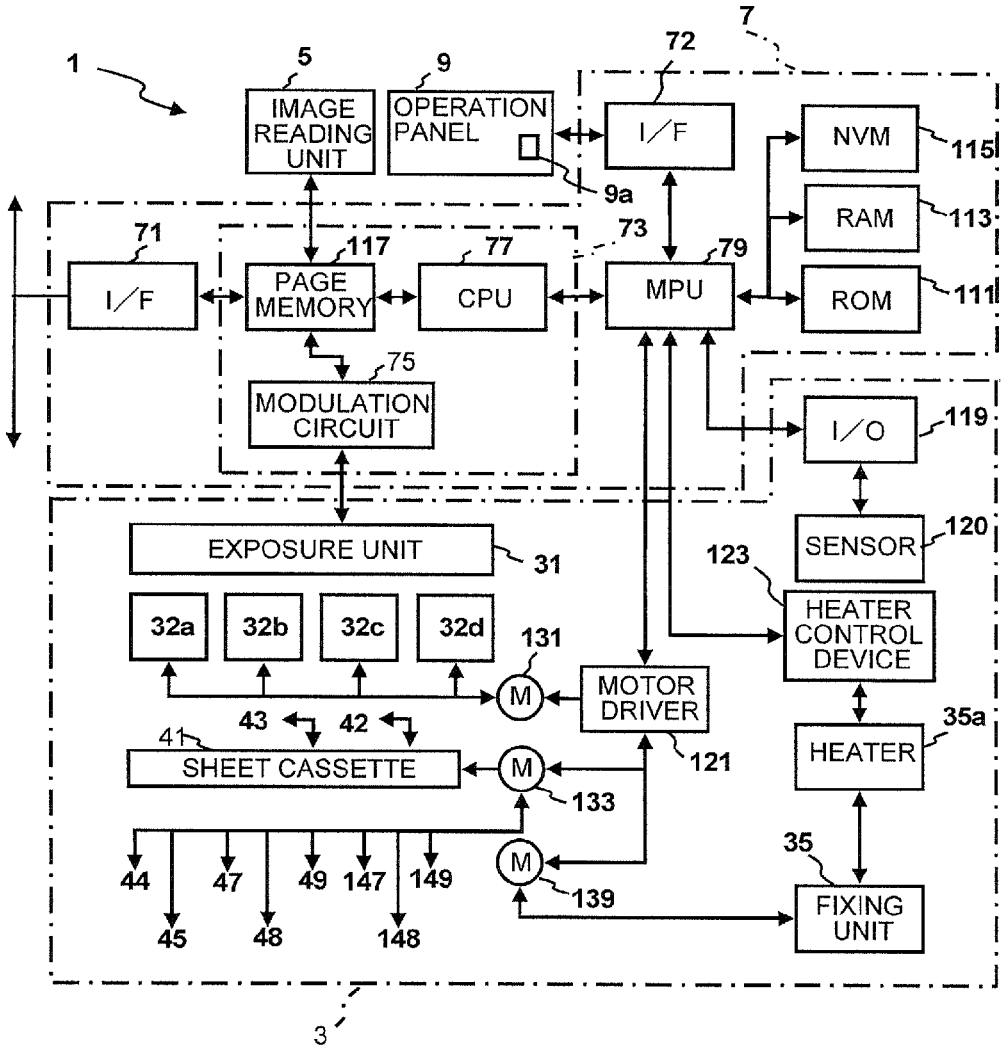
FIG. 3 is a block diagram illustrating a control configuration of the image forming apparatus according to the first embodiment.

The control unit 7 converts the image signal generated by the image reading unit 5 into image data suitable to form an image by the image forming unit 3. As illustrated in FIG. 3, in order to form an image, the control unit 7 performs a process of, for example, character specification, outline correction, and color tone correction (color conversion, RGB→CMY, concentration) on the image signal from the image sensor. The control unit 7 performs a predetermined process such as halftone (gradation), and γ characteristic (input concentration value to output concentration). The image signal and the image data are stored in a storage device (not illustrated), for example, a hard disk drive (HDD) or a semiconductor memory removable from the MFP 1.

The image forming unit 3 includes an exposure unit 31, first to fourth monochromatic image forming stations (visible image forming units) 32*a*, 32*b*, 32*c*, and 32*d*, an intermediate transfer belt 33, a secondary transfer unit 34, a waste toner collecting mechanism 36, an intermediate transfer belt cleaner 37, and a waste toner recovery device 38. When an image is formed, the fixing unit 35 serves as apart of the image forming unit 3.

The image forming unit 3 further includes an automatically duplex unit (ADU) 40, and at least one sheet cassette 41 as a third keeping unit for keeping sheets. The image forming unit 3 further includes a sheet feeding mechanism 42, a separation mechanism 43, and a transport mechanism 44, as a third transport unit provided for each cassette 41. The image forming unit 3 further includes an aligning mechanism 45.

A first mount unit for the first input tray 46 and the first transport unit are provided at the front stage of the aligning mechanism 45. The first mount unit is positioned on a body side face of the MFP 1. The first mount unit includes a rotation fulcrum 46*a*. The first input tray 46 is detachably mounted on the rotation fulcrum 46*a* of the first mount unit. The first input tray 46 keeps sheets which are supplied by a user to form an image. As described above, the first transport unit includes the sheet feeding mechanism 47, the separation mechanism 48, and the timing matching mechanism 49. The first transport units 47 to 49 transport a sheet for forming an image from the first input tray 46 to the fixing unit 35 through an image formation position of the image forming unit 3. The image formation position is a secondary transfer position where a toner image is transferred from the intermediate transfer belt 33 to the sheet by the secondary transfer unit 34. The first input tray 46 can be opened and closed with respect to the body side face of the MFP 1. Specifically, the first input tray 46 is rotatable between a closed position substantially close to the body side face of the MFP 1 and an opened position far away from the body side face of the MFP 1 in a direction of arrow A, in which the rotation fulcrum 46*a* of the first mount unit is the center. Accordingly, when the user uses the input tray 46, the user opens the input tray 46 with respect to the body side face of the MFP 1. When the user does not use the input tray 46, the user closes the input tray 46 with respect to the body side face of the MFP 1.

The second mount unit for the second input tray 146 and the second transport unit are provided at a position between the secondary transfer position and the fixing unit 35 at a subsequent stage of the aligning mechanism 45. In other words, the second mount unit is positioned closer to the fixing unit 35 than the first mount unit. In addition, the second mount unit is positioned on the same side face as the side face of the body of the MFP 1 wherein the first mount unit is positioned. The second mount unit includes a rotation fulcrum 146*a*. The second input tray 46 is detachably mounted on the rotation fulcrum of the second mount unit. The second input tray 146 keeps the sheets which are supplied by the user to erase the image. As described above, the second transport unit includes the sheet feeding mechanism 147, the separation mechanism 148, and the timing matching mechanism 149. The second transport units 147 to 149 transport the sheet for erasing the image from the second input tray 146 to the fixing unit 35 by a transport distance shorter than a sheet transport distance of the first transport units 47 to 49. The second input tray 146 can be opened and closed with respect to the body side face of the MFP 1. Specifically, the second input tray 146 is rotatable between a closed position substantially close to the body side face of the MFP 1 and an opened position far away from the body side face of the MFP 1 in the direction of arrow A, in which the rotation fulcrum 146*a* of the second mount unit is the center. Accordingly, when the user uses the second input tray 146, the user opens the input tray 146 with respect to the body side face of the MFP 1. When the user does not use the second input tray 146, the user closes the input tray 146 with respect to the body side face of the MFP 1.

The configuration of mounting the first input tray 46 on the first mount unit is the same as the configuration of mounting the second input tray 146 on the second mount. Accordingly, for example, the first input tray 46 may be detached from the rotation fulcrum 46*a* (a direction B in FIG. 2), and mounted on the rotation fulcrum 146*a* of the second mount unit (a direction C in FIG. 2), instead of the second input tray 146.

The exposure unit 31 converts the image data output from the image processing unit 73 of the control unit 7, for example, into strength and weakness of laser light. The exposure unit 31 irradiates photoreceptor drums of the first to fourth image forming stations 32*a* to 32*d* with the laser light converted from the image data. The exposure unit 31 forms an electrostatic latent image on each photoreceptor drum by the laser light irradiation. The image forming stations 32*a* to 32*d* develop the electrostatic latent image using color materials of cyan (C), magenta (M), yellow (Y), and black (K), respectively, to form visible images (visualized images) of colors of C, M, Y, and K.

Each of the image forming stations 32*a* to 32*d* includes a photoreceptor drum that is an image bearing body, a development device, and a primary transfer unit. The photoreceptor drum generates an electrostatic latent image corresponding to the laser light irradiated from the exposure unit 31. The development device supplies a toner that is a color material to the photoreceptor drum, to develop the electrostatic latent image. The development device develops the electrostatic latent image to form a toner image (a visualized image) on the photoreceptor drum. The primary transfer unit transfers the toner image formed on the photoreceptor drum onto the intermediate transfer belt 33. An arrangement position of each station, in other words, sequence of colors by which the toner image is formed on the intermediate transfer belt 33 is determined according to an image forming process or characteristics of toner.

The toner includes, for example, a color compound (a precursor compound of pigment) and a developer. The color compound may be, for example, Leuco dye. The developer may be, for example, phenols. The toner is a color material which represents a color by an action of the developer on the color compound and exhibits a predetermined color.

The intermediate transfer belt 33 keeps and transports the toner image formed by each of the stations 32*a* to 32*d*.

The secondary transfer unit 34 transfers the toner image transported by the intermediate transfer belt 33, onto the sheet.

The fixing unit 35 fixes the toner image transferred from the intermediate transfer belt 33 onto the sheet by the secondary transfer unit 34.

The toner remaining on each photoreceptor drum (excess toner) is removed by a cleaner (not illustrated) without transferring from the photoreceptor drum onto the intermediate transfer belt 33. The waste toner collecting mechanism 36 collects the toner removed by the cleaner in the vicinity of the primary transfer unit of each of the stations 32*a* to 32*d*.

In the vicinity of the secondary transfer unit 34, the intermediate transfer belt cleaner 37 removes and collects the toner remaining on the intermediate transfer belt 33 without transferring from the intermediate transfer belt 33 onto the sheet, from the intermediate transfer belt 33.

The waste toner recovery device 38 recovers the transfer residual toner collected by the waste toner collecting mechanism 36 and the transfer residual toner collected by the intermediate transfer belt cleaner 37.

The sheet feeding mechanism 42 takes the sheet out of the cassette 41 at a predetermined timing corresponding to the image forming operation in each of the image forming stations 32*a* to 32*d*. The separation mechanism 43 separates the sheets taken out of the cassette 41, one by one. The transport mechanism 44 transports the sheet separated one by one to a transport position where the intermediate transfer belt 33 and the secondary transfer unit 34 come in contact with each other. In other words, the sheet taken out of the cassette 41 by the sheet feeding mechanism 42 and separated one by one by the separation mechanism 43 is moved to the secondary transfer position through the transport mechanism 44. The aligning mechanism 45 adjusts the timing when the sheet is transported to the secondary transfer position, corresponding to the image forming operation in each of the image forming stations 32*a* to 32*d*.

The fixing unit 35 heats the sheet and the toner image electrostatically attached to the sheet at a predetermined fixing temperature and pressurizes the toner image, to fix the toner image to the sheet. Specifically, the fixing unit 35 heats the toner image electrostatically transferred onto the sheet by the secondary transfer unit 34 at the fixing temperature so as to melt the toner image. In addition, the fixing unit 35 pressurizes the toner image to be fused on the sheet. The toner image keeps the colored state, and is fixed to the sheet.

The sheet to which the toner image is fixed by the fixing unit 35 is transported as an output image to a discharge unit or an ADU 40. The discharge unit is formed, for example, in a space between the image reading unit 5 and the image forming unit 3.

The ADU 40 reverses the front and back of the sheet, to transfer the toner image onto the second face (for example, the back face) of the sheet that is the back face of the first face (for example, the front face) of the sheet to which the toner image is fixed, and transports the sheet reversed front and back to the aligning mechanism 45. As illustrated in FIG. 2, the ADU 40 rotates about a fulcrum 40*a*, and is thereby supported to be opened and closed with respect to the body side face of the MFP 1. For example, the ADU 40 is opened with respect to the body side face of the MFP 1 by the user, in order to remove the sheet from the body when sheet jam occurs. The second input tray 146 is exposed to the outside of the body when the ADU 40 is opened, and is covered with the ADU 40 and is not exposed to the outside of the body when the ADU 40 is closed. In other words, the user can see the second input tray 146 from the outside of the body when the ADU 40 is opened, and cannot see the second input tray 146 from the outside of the body when the ADU 40 is closed. Accordingly, the user can use the second input tray 146 when the ADU 40 is opened. In addition, the rotation fulcrum 146*a* on which the second input tray 146 is mounted is exposed to the outside of the body when the ADU 40 is opened, and is covered with the ADU 40 and is not exposed to the outside of the body when the ADU 40 is closed. Accordingly, the user can mount the first input tray 46 on the rotation fulcrum 146*a* instead of the second input tray 146 when the ADU 40 is opened. It is not necessary that the second input tray 146 be constantly mounted on the rotation fulcrum 146*a*. When the second input tray 146 is necessary, it is preferable that the first input tray 46 is detached from the rotation fulcrum 46*a* and the detached first input tray 46 is mounted on the rotation fulcrum 146*a* as the second input tray 146. By the configuration in which it is possible to substitute the first input tray 46 as the second input tray 146, it is possible to reduce a cost of the MFP 1.

A control configuration of the MFP 1 will be described with reference to FIG. 3. FIG. 3 is a block diagram illustrating a control configuration of the image forming apparatus according to the first embodiment.

As illustrated in FIG. 3, the control unit 7 includes an interface 71 that is an image input unit, an image processing unit 73, and a modulation circuit 75 that is an exposure signal generating unit. The interface 71 receives image data supplied from an external device such as a personal computer (PC) or image data supplied through, for example, a network. The image processing unit 73 performs a predetermined image process for character specification, outline correction, tone correction, and γ characteristic described above, on the image signal generated by the image reading unit 5 or the image data from the interface 71. The modulation circuit 75 converts the image data processed by the image processing unit 73 into a modulation signal (an exposure signal) for laser light of the exposure unit 31.

The control unit 7 includes a central processing unit (CPU) 77, and a main processing unit (MPU) 79. The CPU 77 controls an image signal system such as the input interface 71, the image processing unit 73, and the modulation circuit 75. The MPU 79 is connected to the CPU 77, and controls an image reading operation, an image forming operation, and a heating temperature (fixing temperature→erasing temperature/erasing temperature→fixing temperature) of the fixing unit 35 at the time of erasing to be described hereinafter. The MPU 79 controls units of the MFP 1 according to a control input from the operation panel 9 receiving an instruction of the user with respect to the MFP 1. The operation panel 9 includes a display panel 9*a*. The display panel 9*a* displays states of the units of the MFP 1, for example, a waiting time for changing the heating temperature at the time of erasing and at the time of mounting, by a user interface widely known as, for example, a character line or a sign (pictogram/icon). The display panel 9*a* receives the control input by the user, and displays the contents of the received input. The display panel 9*a* displays the various kinds of contents according to the control of the MPU 79. The MPU 79 is connected to an I/F (interface) 72 for inputting and outputting information between the interface 72 and the operation panel 9.

The control unit 7 includes a read only memory (ROM) 111 that stores a program, a random access memory (RAM) 113, a non-volatile memory (NVM) 115, and a page memory 117. The page memory 117 is a work memory that provides a work area of an image process in the image processing unit 73. The MPU 79 is connected to the ROM 111, the RAM 113, and the page memory 117. The MPU 79 is connected to an input/output port (I/O port) 119. The I/O port 119 inputs the output of a sensor 120 to the MPU 79. The sensor 120 includes an ADU sensor that detects opening and closing of the ADU 40, and a tray sensor that detects a usable state of any one of the first input tray 46 and the second input tray 146. The usable state of any one of the first input tray 46 and the second input tray 146 is a state where the first input tray 46 or the second input tray 146 is mounted on either of the rotation fulcrum 46*a* and the rotation fulcrum 146*a*.

The sensor 120 further includes, for example, a temperature sensor that detects a heating temperature of the fixing unit 35, a sheet sensor that detects whether there is a sheet in the input tray 146, and a discharge sensor that detects that the sheet passes through the fixing unit 35.

The MPU 79 is connected to a motor driver 121 that controls rotation of arbitrary motors 131, 133, . . . , 139. The motor 131 drives, for example, the first to fourth image forming stations 32*a* to 32*d*, and the intermediate transfer belt 33. The motor 133 drives the sheet transport units from the cassette to the fixing unit 35 and the ADU 40, for example, the third transport units 42 to 44, the aligning mechanism 45, and the secondary transfer unit 34. The motor 133 further drives the sheet transport units from the input tray 46 to the fixing unit 35, for example, the first transport units 47 to 49. The motor 133 further drives the sheet transport units from the second input tray 146 to the fixing unit 35, for example, the second transport units 147 to 149. The motor 139 drives the fixing unit 35 independently from the transport unit. As will be described later, the motor 133 drives any one of the first transport units 47 to 49 and the second transport units 147 to 149, and stops driving of the other transport unit, according to the output (the detection result) of the tray sensor. The first transport units 47 to 49 and the second transport units 147 to 149 may be driven by an independent motor.

The MPU 79 is connected to a heater control device 123 that drives a heater 35*a* for changing the heating temperature of the fixing unit 35. As will be described later, the heating temperature can be changed by the heater 35*a*, and thus the fixing unit 35 serves as an erasing unit that erases an image on a sheet.

Figure 4:
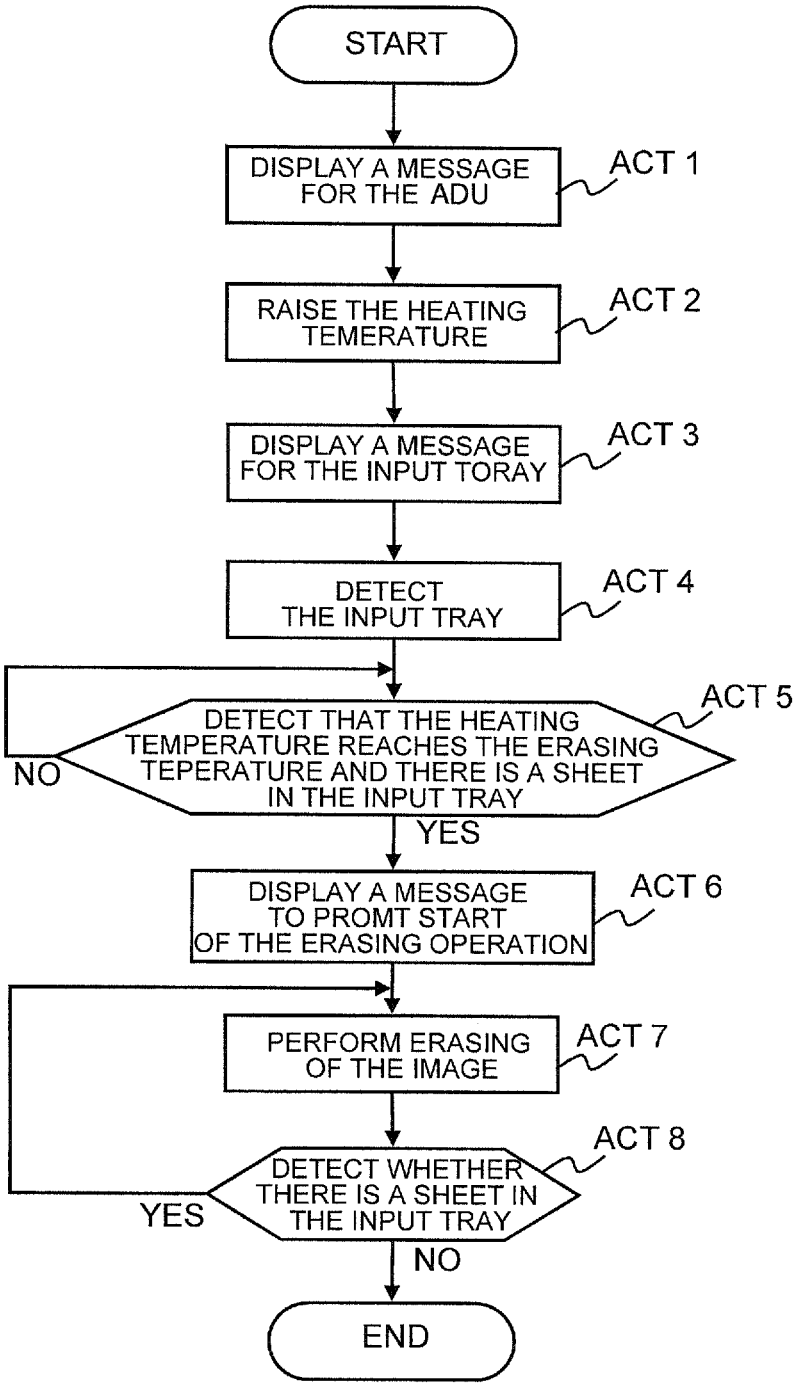
FIG. 4 is a flowchart illustrating the erasing operation of the image forming apparatus according to the first embodiment.

The erasing operation of the fixing unit (the erasing unit) 35 will be described with reference to FIGS. 2 and 4. FIG. 4 is a flowchart illustrating an erasing operation of the MFP 1.

When the image (the toner image) formed on the sheet is an erasable toner, it is possible to resolve the coloring state of the toner by heating the toner at the erasing temperature. In other words, it is possible to erase the color by heating the toner at the erasing temperature.

The erasable toner includes, for example, a color compound (a precursor compound of pigment), a developer, and a decolorant. The color compound may be, for example, Leuco dye. The developer may be, for example, phenols. The decolorant may be a substance which is dissolved with the color compound by heating at the erasing temperature and does not have an affinity with the developer. The erasable toner is colored by the action of the developer on the color compound, and is decolored since the effect action of the developer on the color compound is reduced by heating equal to or higher than the erasing temperature.

The fixing unit 35 heats the image on the sheet by the heater 35*a*. The fixing unit 35 can change the heating temperature to the fixing temperature and the decoloring temperature higher than the fixing temperature by the heater 35*a*. When the heating temperature of the fixing unit 35 is the fixing temperature, the fixing unit 35 fixes the image on the sheet as described above. When the heating temperature of the fixing unit 35 is the erasing temperature, the fixing unit 35 serves as the erasing unit. The fixing unit 35 heats the image on the sheet at the erasing temperature to decolor the toner, thereby erasing the image (the toner image) on the sheet. The MFP 1 does not independently have the erasing unit, and can erase the image on the sheet by the fixing unit 35. The heater 35*a* is configured by, for example, a heater lamp built in a roller, or an induction heating (IH) heater that causes induction heat on a metal layer of a belt or a metal face of a roller.

As described in FIG. 4, in Act 1, the control unit 7 controls the display panel 9*a* to display a message such as "Please, open ADU", based on selection of the erasing operation from the operation panel 9 by the user.

In Act 2, the control unit 7 instructs the heater driving device 123 to control the heater 35*a*. The heater driving device 123 starts a temperature control of the heater 35*a* to raise the heating temperature of the fixing unit 35 to the erasing temperature according to the instruction from the control unit 7.

In Act 3, the control unit 7 determines whether the ADU 40 is opened, based on the detection result of the ADU sensor input to the control unit 7 through the I/O port 119. As illustrated in FIG. 2, the control unit 7 determines that the ADU 40 is opened, the control unit 7 controls the display panel 9*a* to display a message of prompting the user to prepare the erasing operation, for example, "Please, mount the input tray into the ADU".

In Act 4, the control unit 7 determines whether the first input tray 46 or the second input tray 146 is mounted on the rotation fulcrum 146*a*, based on the detection result of the tray sensor input through the I/O port 119. Hereinafter, in the description, it is assumed that the first input tray 46 is mounted on the rotation fulcrum 146*a*. As illustrated in FIG. 2, when the control unit 7 determines that the input tray 146 is mounted on the rotation fulcrum 146*a*, the operation of the MFP 1 proceeds to Act 5.

In Act 5, the control unit 7 determines whether the heating temperature of the fixing unit 35 reaches the erasing temperature, based on the detection result of the temperature sensor input through the I/O port 119.

In addition, in Act 5, the control unit 7 determines whether there is a sheet in the first input tray 46 mounted on the rotation fulcrum 146*a*, based on the detection result of the sheet sensor input through the I/O port 119. When the control unit 7 determines that there is no sheet in the first input tray 46, the control unit 7 controls the display panel 9*a* to display a message of prompting preparation of the erasing operation, for example, "Please, place a sheet on the input tray". When the control unit 7 determines that the heating temperature of the fixing unit 35 reaches the erasing temperature and there is a sheet in the first input tray 46 (Yes in Act 5), the operation of the MFP 1 proceeds to Act 6.

In Act 6, the control unit 7 controls the display panel 9*a* to display a message of prompting start of the erasing operation such as "Please, press a start button".

In Act 6, when the control unit 7 determines that the operation panel 9 receives the press of the start button, the operation of the MFP 1 proceeds to Act 7.

In Act 7, the control unit 7 instructs the motor driver 121 to control driving of the motor 133 and the motor 139. The motor driver 121 controls the motor 133 to drive the second transport units 147 to 149. The motor 133 drives the second transport mechanism. The second transport units 147 to 149 transport the sheet from the first input tray 46 mounted on the rotation fulcrum 146*a* to the fixing unit 35. The motor driver 121 controls the motor 139 to drive the fixing unit 35. The motor 139 drives the fixing unit 35. The fixing unit 35 erases the image on the sheet as transporting the sheet.

In Act 7, the control unit 7 determines whether the sheet passes through the fixing unit 35, in other words, the erasing of the image on one sheet is completed, based on the detection result of the discharge sensor input through the I/O port 119.

When the control unit 7 determines that the erasing of the image on one sheet is completed, the operation of the MFP 1 proceeds to Act 8.

In Act 8, the control unit 7 determines whether there is a sheet in the first input tray 46 mounted on the rotation fulcrum 146*a*, based on the detection result of the sheet sensor input through the I/O port 119. When the control unit 7 determines that there is the sheet in the first input tray 46 (Yes in Act 8), the operation of the MET 1 returns to Act 7. When the control unit 7 determines that there is no sheet in the first input tray 46 (No in Act 8), the operation of the MFP 1 is in a waiting state.

Since the ADU 40 is opened during the erasing operation of Act 7, the motor driver 121 controls the motor 133 and the motor 139 to drive only the fixing unit 35 and the second transport units 147 to 149. Accordingly, since power consumed by the motor 131 and the like driving the image forming stations 32*a* to 32*d* is not necessary, it is possible to save power consumption of the MFP 1.

As described above, the first input tray 46 is configured to be detachable from the rotation fulcrum 46*a* by being moved in the direction of the arrow B in FIG. 2, and be attachable on the rotation fulcrum 146*a* as the second input tray 146 by being moved in the direction of the arrow C, but is not limited to this configuration. The configuration of attaching and detaching of the first input tray 46 may be an arbitrary configuration which does not disturb the transport of the sheet.

Figure 5:
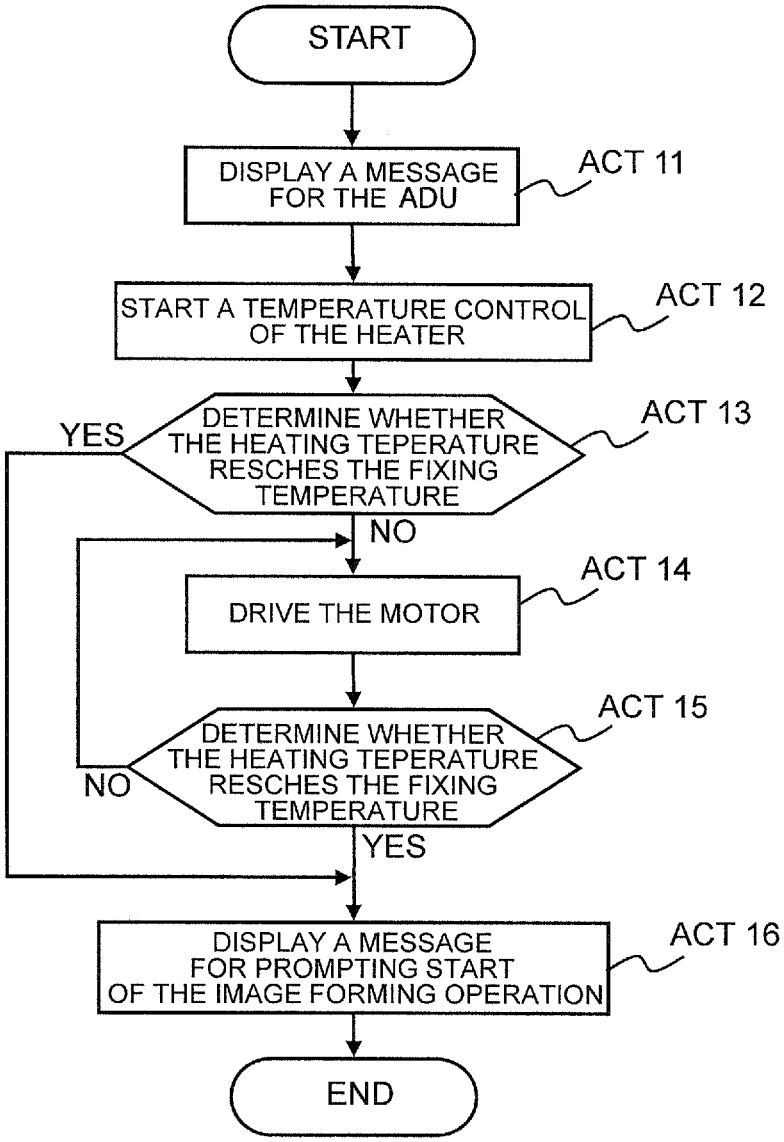
FIG. 5 is a flowchart illustrating a return operation from the erasing operation to an image forming operation in the image forming apparatus according to the first embodiment.

The operation returning from the erasing operation to the image forming operation will be described with reference to FIG. 5. FIG. 5 is a flowchart illustrating the returning operation from the erasing operation to the image forming operation in the MFP 1.

In the erasing operation of FIG. 4, in order to erase the image on the sheet, the heating temperature of the fixing unit 35 is changed to the erasing temperature higher than the fixing temperature. Accordingly, when the user instructs the image forming operation, a temperature control is necessary to lower the heating temperature of the fixing unit 35 from the erasing temperature to the fixing temperature.

As illustrated in FIG. 5, in Act 11, the control unit 7 controls the display panel 9*a* of the operation panel 9 to display a message, for example, "Please, detach the input tray from the ADU, and close the ADU", based on the selection of the image forming operation by the user from the operation panel 9.

In Act 12, the control unit 7 instructs the heater driving device 123 to control the heater 35*a*. The heater driving device 123 starts the temperature control of the heater 35*a* to lower the heating temperature of the fixing unit 35 to the fixing temperature according to the instruction from the control unit 7.

In Act 13, the control unit 7 determines whether the heating temperature of the fixing unit 35 reaches the fixing temperature, based on the detection result of the temperature sensor input through the I/O port 119.

Specifically, the control unit 7 predicts, for example, whether the time required for the heating temperature of the fixing unit 35 to reach the fixing temperature is longer than a predetermined time.

In Act 13, when the control unit 7 predicts that the time required for the heating temperature of the fixing unit 35 to reach the fixing temperature is longer than the predetermined time (No in Act 13), the operation of the MFP 1 proceeds to Act 14. In Act 14, the control unit 7 instructs the motor driver 121 to control driving of the motor 139. The motor driver 121 controls only the motor 139. The motor 139 is operated for a predetermined time to drive a roller and a belt of the fixing unit 35 to be described later. By driving the roller and the belt of the fixing unit 35, the decrease of the heating temperature of the fixing unit 35 is promoted. The case where the control unit 7 predicts that the time required for the heating temperature of the fixing unit 35 to reach the fixing temperature is longer than the predetermined time is a case where the heating temperature of the fixing unit 35 is higher than the fixing temperature, and for example, a difference between the heating temperature and the fixing temperature is equal to or more than 10% of the fixing temperature.

In Act 15, after driving the fixing unit 35 for the predetermined time, the control unit 7 determines whether the heating temperature of the fixing unit 35 reaches the fixing temperature, based on the detection result of the temperature sensor input through the I/O port 119 again.

Specifically, as described above, the control unit 7 predicts whether the time required for the heating temperature of the fixing unit 35 to reach the fixing temperature is longer than the predetermined time.

In Act 15, when the control unit 7 predicts that the time required for the heating temperature of the fixing unit 35 to reach the fixing temperature is longer than the predetermined time (No in Act 15), the operation of the MFP 1 returns to Act 14. In Act 14, as described above, the motor driver 121 controls only the motor 139. The motor 139 drives the roller and belt of the fixing unit 35.

In Act 13, when the control unit 7 predicts that the time required for the heating temperature of the fixing unit 35 to reach the fixing temperature is within the range of the time (Yes in Act 13), the operation of the MFP 1 proceeds to Act 16. In addition, in Act 15, when the control unit 7 predicts that the time required for the heating temperature of the fixing unit 35 to reach the fixing temperature is within the range of the predetermined time (Act 15: Yes), the operation of the MFP 1 proceeds to Act 16. The case where the control unit 7 predicts that the time required for the heating temperature of the fixing unit 35 to reach the fixing temperature is within the range of the time is a case where the heating temperature of the fixing unit 35 is higher than the fixing temperature, but for example, a difference between the heating temperature and the fixing temperature is less than 10% of the fixing temperature. In Act 16 (display a message for prompting start of the image forming operation), the control unit 7 controls the display panel 9*a* of the operation panel 9 to display a message for prompting the image forming operation of the user, for example, "Ready to copy". After the message for prompting the image forming operation of the user is displayed, a little time lag may occur until actually the temperature of the fixing unit 35 becomes completely the fixing temperature. However, the time lag is not to the extent to be aware of an undesired waiting time by the user. For example, considering the occurrence of the time lag, the display panel 9*a* may display a message such as "Please, wait for about 10 seconds".

Figure 6:
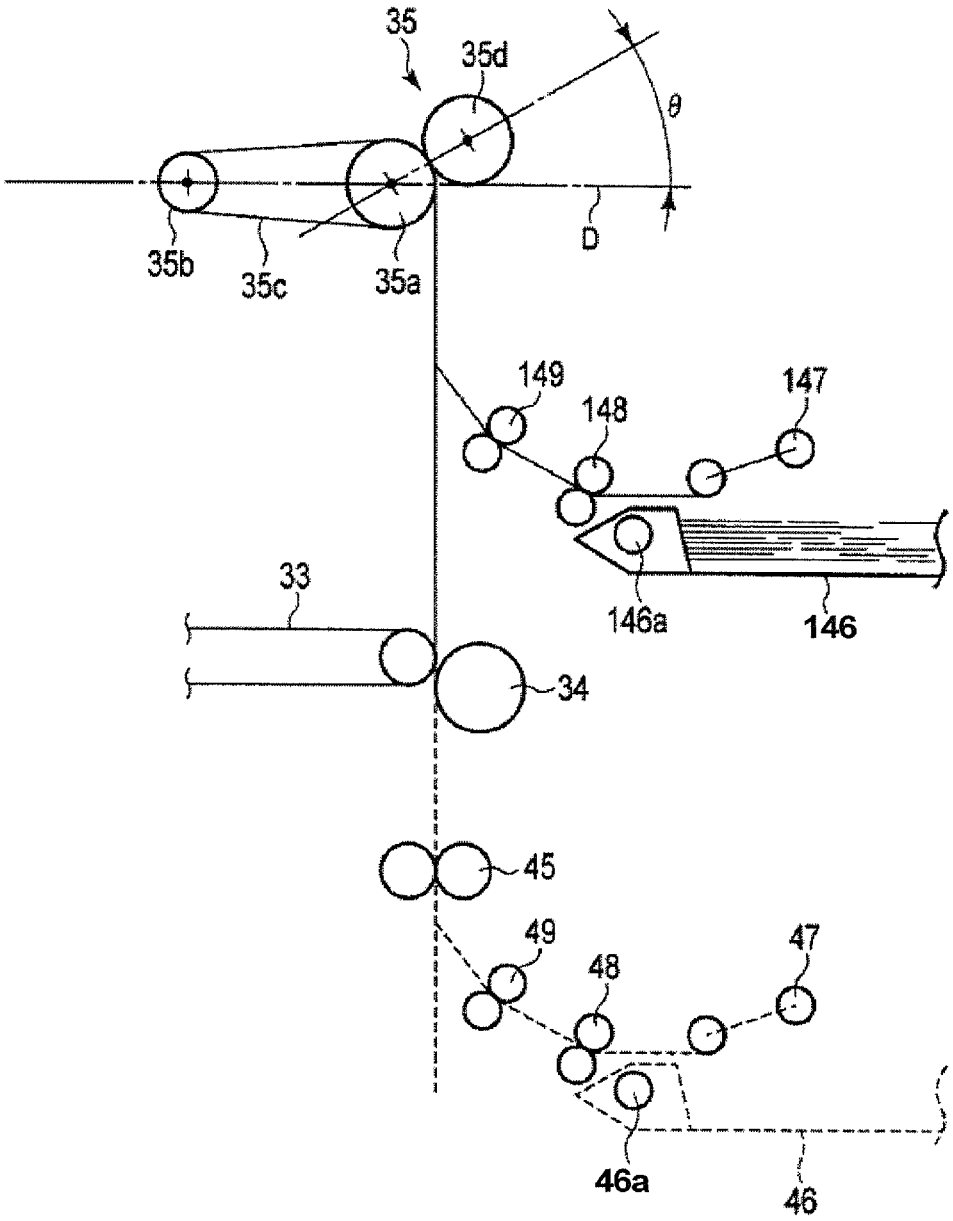
FIG. 6 is a diagram illustrating a transport path of a sheet at the time of the erasing operation of the image forming apparatus according to the first embodiment.

Characteristics of the fixing unit 35 related to the first input tray 46, the first transport units 47 to 49, the second input tray 146, and the second transport units 147 to 149 will be described with reference to FIG. 6. FIG. 6 is a diagram illustrating transport of the sheet at the time of the erasing operation of the MFP.

The fixing unit 35 is disposed at the more downstream position than the secondary transfer position on a transport path (hereinafter, referred to as an image forming transport path) on which the sheet from the cassette 41 and the first input tray 46 are transported through the secondary transfer position. In addition, the sheet from the second input tray 146 is transported by the second transport units 147 to 149 in the image forming transport path between the fixing unit 35 and the transfer position. In other words, the fixing unit 35 is disposed such that the transport distance in which the sheet from the second input tray 146 is transported to the fixing unit 35 is shorter than the transport distance in which the sheet from the cassette 41 and the first input tray 46 are transported to the fixing unit 35. Accordingly, in the MFP 1, it is possible to reduce that the sheet transported from the second input tray 146 causes a transport defect (sheet jam).

As illustrated in FIG. 6, the fixing unit 35 includes endless bodies 35*a*, 35*b*, 35*c*, and 35*d*. The endless bodies 35*a*, 35*b*, and 35*d* are formed of, for example, rollers. Hereinafter, the endless bodies 35*a*, 35*b*, and 35*d* are referred to as a first roller 35*a*, a second roller 35*b*, and a third roller 35*d*. The endless body 35*c* is formed of, for example, an endless belt. Hereinafter, the endless body 35*c* is referred to as an endless belt 35*c*.

The first roller 35*a* and the second roller 35*b* give tension to support the endless belt 35*c*. The third roller 35*d* is disposed closer to the rotation fulcrum 146*a* of the second input tray 146 than the first roller 35*a* and the second roller 35*b*. The third roller 35*d* comes in contact with the endless belt 35*c* in a direction far away from the fulcrum 146*a* of the second input tray, at an angle θ, in the transport direction of the sheet, to form a nip. In other words, the third roller 35*d* forms the nip at the angle θ with respect to a line segment D perpendicular to the transport direction of the sheet through the rotation center of the first roller 35*a*. The fixing unit 35 heats the image on the sheet while transporting the sheet with the sheet interposed at the nip.

Disposition of the third roller 35*d* makes the sheet be easily transported to the nip, as compared with the case (the angle θ is 0 degree) where the third roller 35*d* is disposed on an extending line of the line segment D. In other words, the disposition of the third roller 35*d* reduces a load to the sheet when the sheet enters the nip.

Figure 7:
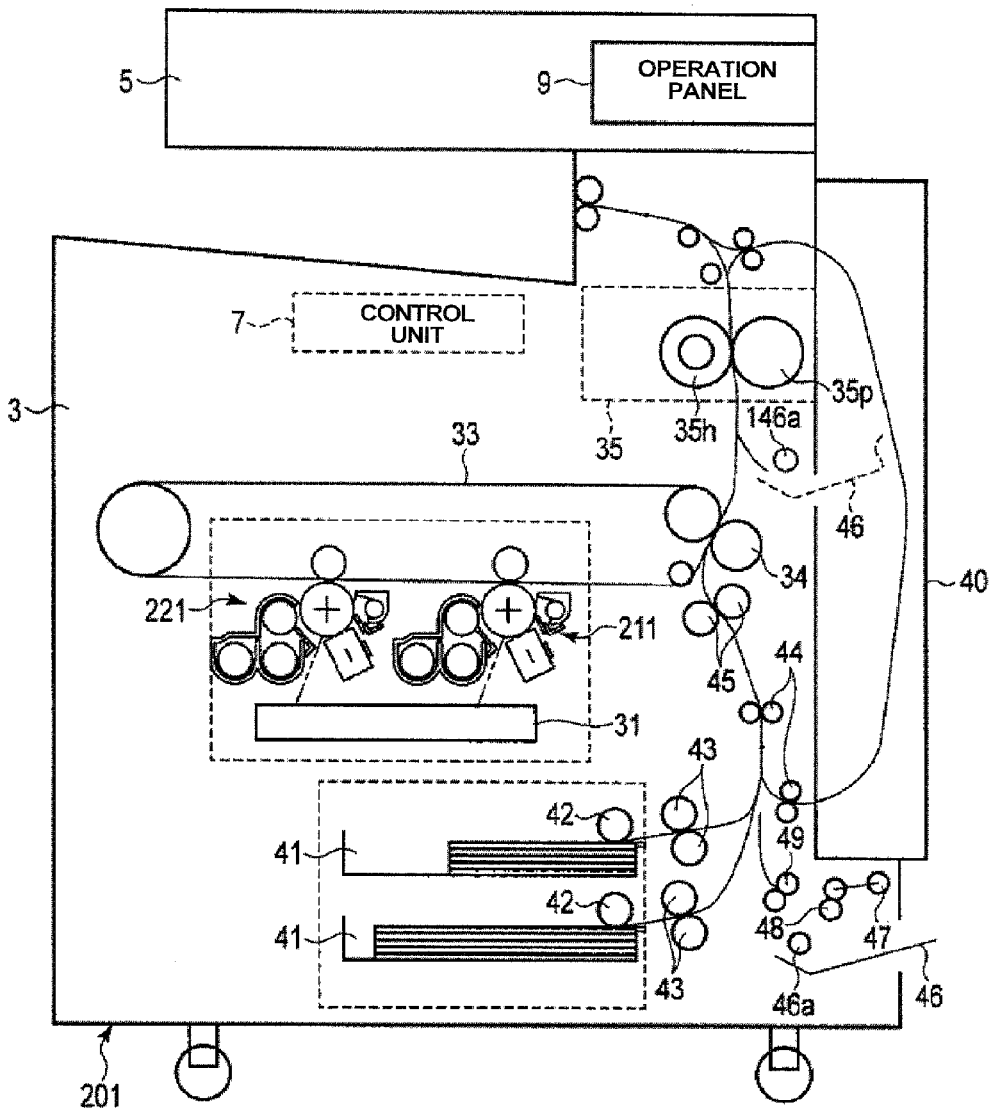
FIG. 7 is a cross-sectional view illustrating main units of an image forming apparatus according to a second embodiment.

A second embodiment will be described with reference to FIG. 7. FIG. 7 is a cross-sectional view illustrating main units of an image forming apparatus according to the second embodiment. The MFP 1 illustrated in FIGS. 1 and 2 includes the image forming stations 32*a* to 32*d* of four colors of C, M, Y, Bk for forming a color image, but an image apparatus 201 according to the second embodiment is an MFP including first and second image forming stations 211 and 221 for forming a monochromatic image as illustrated in FIG. 7. The first image forming station 211 forms an image using an erasable toner. The second image forming station 221 forms an image using a non-erasable toner. In the operation panel 9, the user selects any image forming operation of forming of an erasable image or forming of a non-erasable image. The MFP 201 operates any image forming stations of the first image forming station 211 and the second image forming station 221 to form an image, based on selection of the image forming operation by the user from the operation panel 9. The fixing unit 35 of the MFP 201 includes a heat roller 35*h* and a press roller 35*p*. The fixing unit 35 heats the image on the sheet with the sheet interposed at a nip formed between the heat roller 35*h* and the press roller 35*p*. The configuration of the MFP 201 except for the image forming station and the fixing device is the same as that of the MFP 1 described above, and the description thereof is omitted.

Figure 8:
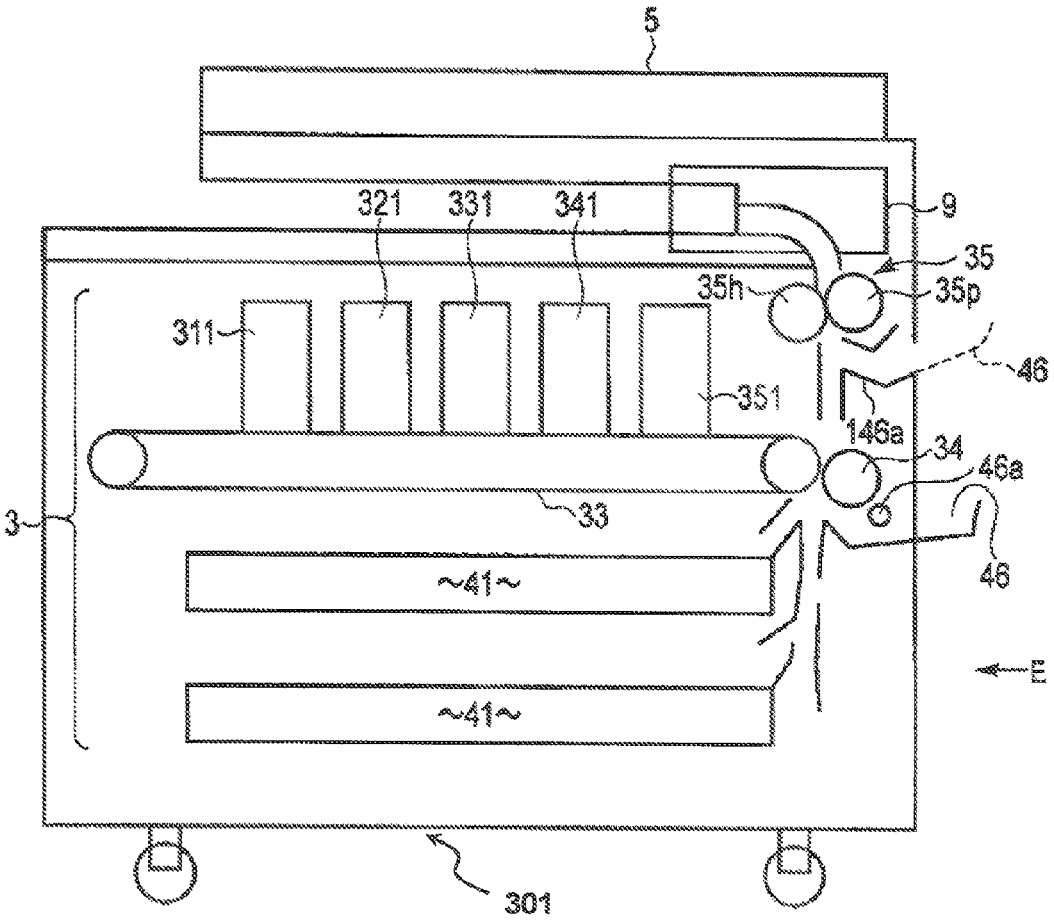
FIG. 8 is a cross-sectional view illustrating main units of an image forming apparatus according to a third embodiment.

A third embodiment will be described with reference to FIG. 8. FIG. 8 is a cross-sectional view illustrating main units of an image forming apparatus according to the third embodiment. As illustrated in FIG. 8, an image forming apparatus 301 is an MFP including image forming stations 311, 321, 331, and 341 of four colors of C, M, Y, and Bk for forming a color image, and a fifth image forming station 351 for forming a monochromatic image using an erasable toner according to the third embodiment.

As illustrated in FIG. 8, the fixing unit 35 of the MFP 301 has the same configuration as that of the MFP 201 described above.

As illustrated in FIG. 8, the MFP 301 does not include an automatic double-side unit (ADF). In a case of MFP 301, the rotation fulcrum 146*a* of the second input tray 146 is visible from the body side (a direction of an arrow E in the drawing). Accordingly, in the MFP 301, user's operation of opening the ADF with respect to the body side face to mount the first input tray 46 as the second input tray 146 is unnecessary.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus which has a function of forming an image on a sheet and a function of erasing the image formed on the sheet, comprising:

an image forming unit that forms an image on a sheet;

a heating unit configured to heat the image formed on the sheet at a fixation temperature to fix the image to the sheet, and to heat the image formed on the sheet at an erasing temperature higher than the fixation temperature to erase the image;

first and second keeping units configured to keep sheets, wherein the first and second keeping units are mounted on mount units of the image forming apparatus positioned on a same side face of the image forming apparatus and at positions different from each other, the mount unit for the second keeping unit is positioned closer to the heating unit than the mount unit for the first keeping unit, the first and second keeping units are detachably mounted on the mount units, the first keeping unit is detachably mounted as the second keeping unit on the mount unit for the second keeping unit, the first and second keeping units are rotatable between a closed position close to the side face of the image forming apparatus and an opened position far away from the side face of the image forming apparatus in a state where the first and second keeping units are mounted on the mount units, respectively;

a first transport unit configured to transport the sheet from the first keeping unit to the heating unit through an image formation position of the image forming unit to form the image; and a second transport unit configured to transport the sheet from the second keeping unit to the heating unit by a transport distance shorter than a sheet transport distance of the first transport unit.

2. The image forming apparatus according to claim 1, further comprising a control unit that controls driving of the first transport unit and the second transport unit, wherein the control unit stops driving of the first transport unit while driving the second transport unit to erase the image.

3. The image forming apparatus according to claim 2, wherein the control unit drives the second transport unit and stops driving of the first transport unit in a state where the first keeping unit is mounted on the mount unit for the second keeping unit.

4. The image forming apparatus according to claim 3, wherein the control unit controls driving of the image forming unit, and stops driving of the image forming unit while driving the second transport unit to erase the image.

* * * * *